US007461647B1

(12) United States Patent
Slinkard

(10) Patent No.: US 7,461,647 B1
(45) Date of Patent: Dec. 9, 2008

(54) ARROW HOLDER FOR LOADING AND SHOOTING MULTIPLE ARROWS IN SUCCESSION

(76) Inventor: Michael D. Slinkard, 62091 Dugout La., John Day, OR (US) 97845

( * ) Notice: Subject to any disclaimer, the term of this patent is extended or adjusted under 35 U.S.C. 154(b) by 334 days.

(21) Appl. No.: 11/344,640

(22) Filed: Jan. 31, 2006

(51) Int. Cl.
*F41B 5/06* (2006.01)

(52) U.S. Cl. ..... 124/86; 124/25.7

(58) Field of Classification Search ..... 124/25.5, 124/25.7, 44.5, 86; 221/191, 303; 224/916
See application file for complete search history.

(56) References Cited

U.S. PATENT DOCUMENTS 2,503,741 A * 4/1950 Johnson ..... 221/303
2,779,522 A * 1/1957 Puckett ..... 221/185
3,224,822 A * 12/1965 Kirby ..... 312/71
3,595,215 A * 7/1971 Wilkie et al. ..... 124/52
3,601,113 A * 8/1971 Wilkie ..... 124/48
4,583,659 A * 4/1986 Carter ..... 221/279
5,544,641 A * 8/1996 Jenn ..... 124/25
6,000,589 A * 12/1999 Burdine ..... 224/196

* cited by examiner

*Primary Examiner*—John Ricci
(74) *Attorney, Agent, or Firm*—David S. Alavi

(57) ABSTRACT

An arrow holder comprises: a U-shaped bracket; an arrow catch extending from one side of the bracket toward the other leaving a vertical gap; a spring member for biasing an arrow stack within the bracket against the arrow catch; and opposed arrow guides at the front end of the bracket. The arrow guides extend vertically to constrain horizontally the top arrow of the stack. The bracket, arrow catch, arrow guides, and spring member are arranged for: enabling the top arrow to pivot about the arrow guides and pass through the gap; releasing the top arrow when it pivots sufficiently to clear the arrow catch; and biasing the remainder of the stack against the arrow catch if the top arrow is released. A method comprises pivoting the top arrow thereby releasing it from the arrow holder. The method may further comprise inserting the single stack of arrows into the arrow holder.

22 Claims, 12 Drawing Sheets

10a
10b
108a
108b
102a
102b
104

ARROW HOLDER FOR LOADING AND SHOOTING MULTIPLE ARROWS IN SUCCESSION

BACKGROUND

The field of the present invention relates to archery. In particular, an arrow holder mounted on an archery bow is disclosed herein that holds multiple arrows in a position facilitating loading and shooting the multiple arrows in succession.

A variety of arrow holders, or quivers, exist in the field of archery for holding multiple arrows. Such holders may typically be intended to keep the multiple held arrows readily at hand for reloading the bow. In speed shooting competitions, hunting, or other circumstances, it may be desirable to reload the bow as rapidly as possible to reduce the time taken between shots. Previous quivers for speed shooting are leg- or hip-mounted, or comprise ground-mounted holders or tubes. Previous bow-mounted quivers are typically on the side of the bow opposite the arrow rest, and typically hold the arrows in a substantially vertical orientation (i.e. perpendicular to the direction required for nocking, drawing, and shooting the arrow).

SUMMARY

An arrow holder comprises: a U-shaped bracket having a bottom and first and second opposed substantially vertical sides; an arrow catch extending substantially horizontally from a top edge of the first side of the bracket toward the second side; a spring member positioned within the bracket for biasing an arrow stack within the U-shaped bracket against the arrow catch; and first and second opposed substantially vertical arrow guides at the front end of the bracket. The sides are substantially parallel and spaced apart so as to receive a single stack of arrows therebetween within the bracket with the arrows protruding beyond front and back ends of the bracket. The arrow catch is positioned so as to leave a vertical gap between the arrow catch and a top edge of the second side of the bracket for enabling one arrow at a time to pass between the arrow catch and the top edge of the second side. The arrow guides are spaced apart so as to receive the single stack of arrows therebetween, and extend vertically so as to constrain horizontally a top arrow of the arrow stack. The bracket, arrow catch, arrow guides, and spring member are arranged for: enabling a top arrow of the received arrow stack to pivot substantially horizontally about the arrow guides and pass through the vertical gap between the arrow catch and the top edge of the second side of the bracket; releasing the top arrow of the received arrow stack from the arrow holder when the top arrow pivots about the arrow guides through an angle sufficient to clear the arrow catch; and biasing a remainder of the received arrow stack against the arrow catch if the top arrow is released.

A method comprises pivoting the top arrow of the arrow stack about the arrow guides so that it passes through the vertical gap and clears the arrow catch thereby releasing the top arrow of the arrow stack from the arrow holder. The spring member biases the remainder of the arrow stack against the arrow catch after release of the top arrow of the arrow stack from the arrow holder. The method may further comprise inserting the single stack of arrows into the arrow holder with the arrow stack biased by the spring member against the arrow catch.

Objects and advantages pertaining to quivers or other arrow holders may become apparent upon referring to the exemplary embodiments illustrated in the drawings and disclosed in the following written description and/or claims.

Figure 2:
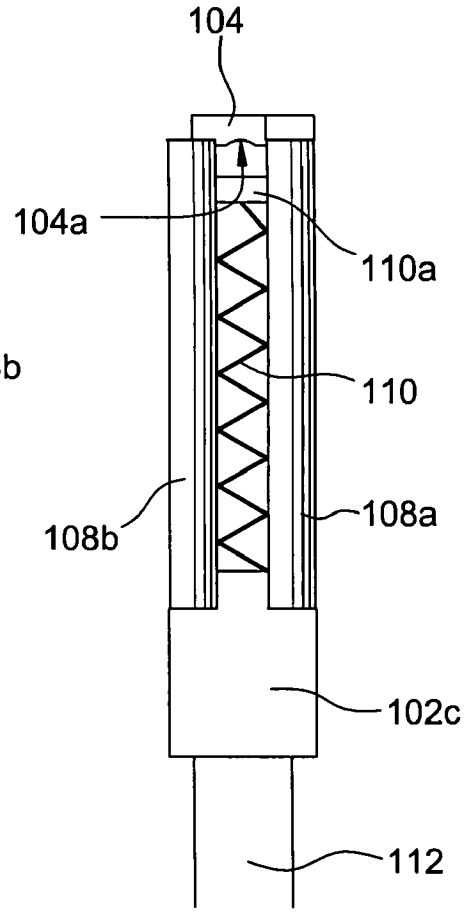
FIGS. 1-6 are schematic right side, front, left side, back, and isometric views, respectively, of an arrow holder.
Figure 1:
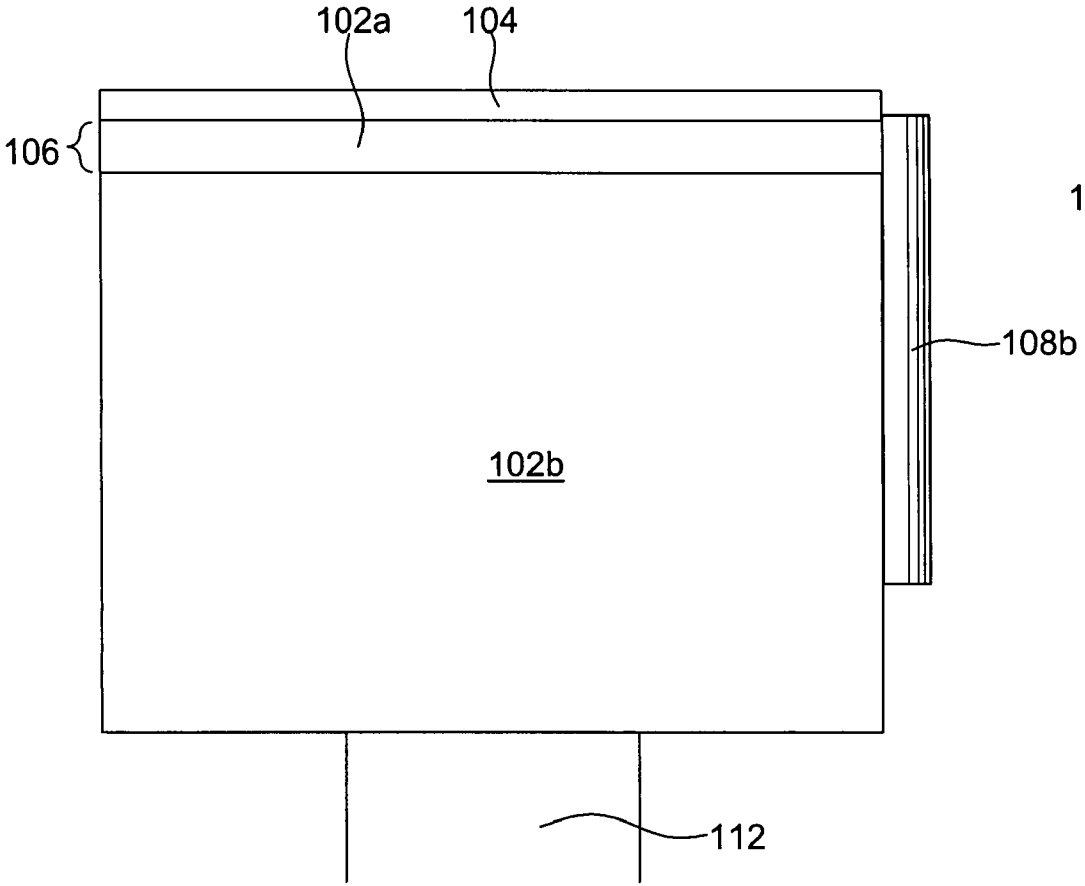
Figure 4:
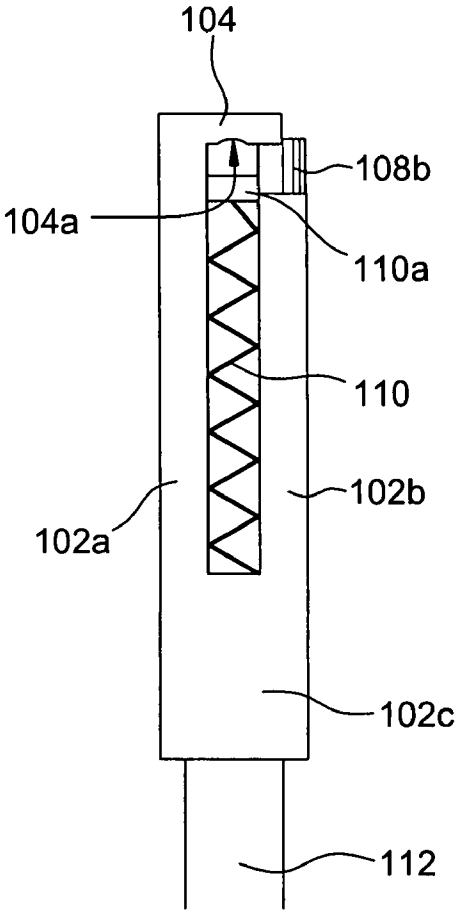
Figure 3:
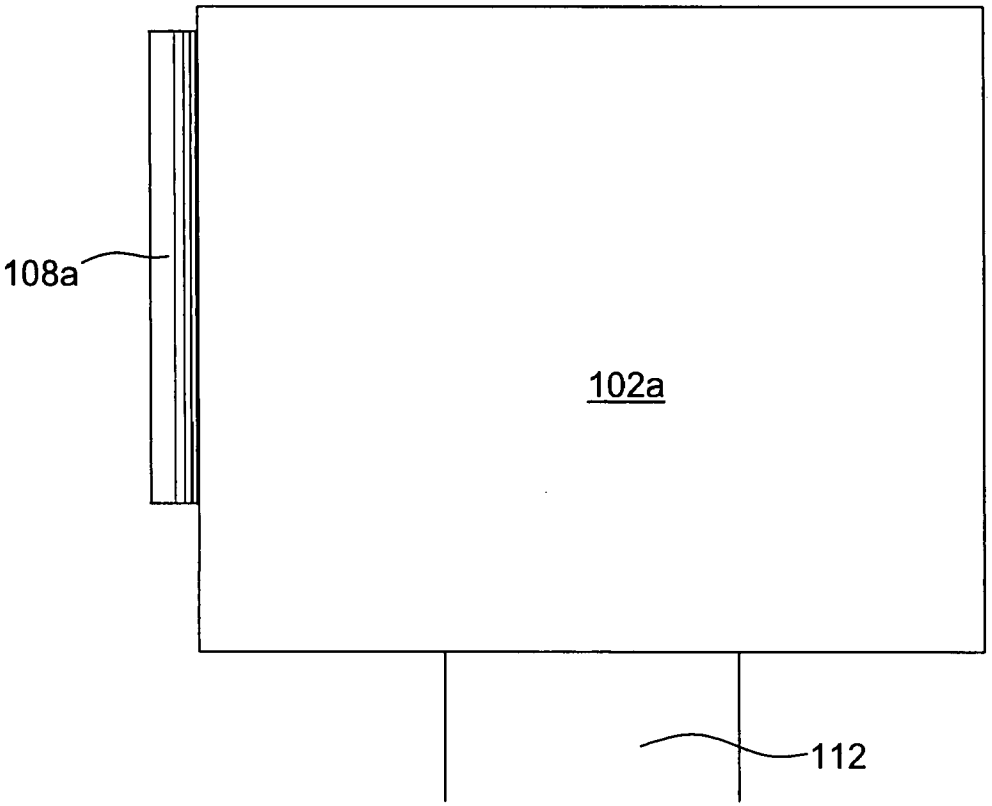
Figure 5:
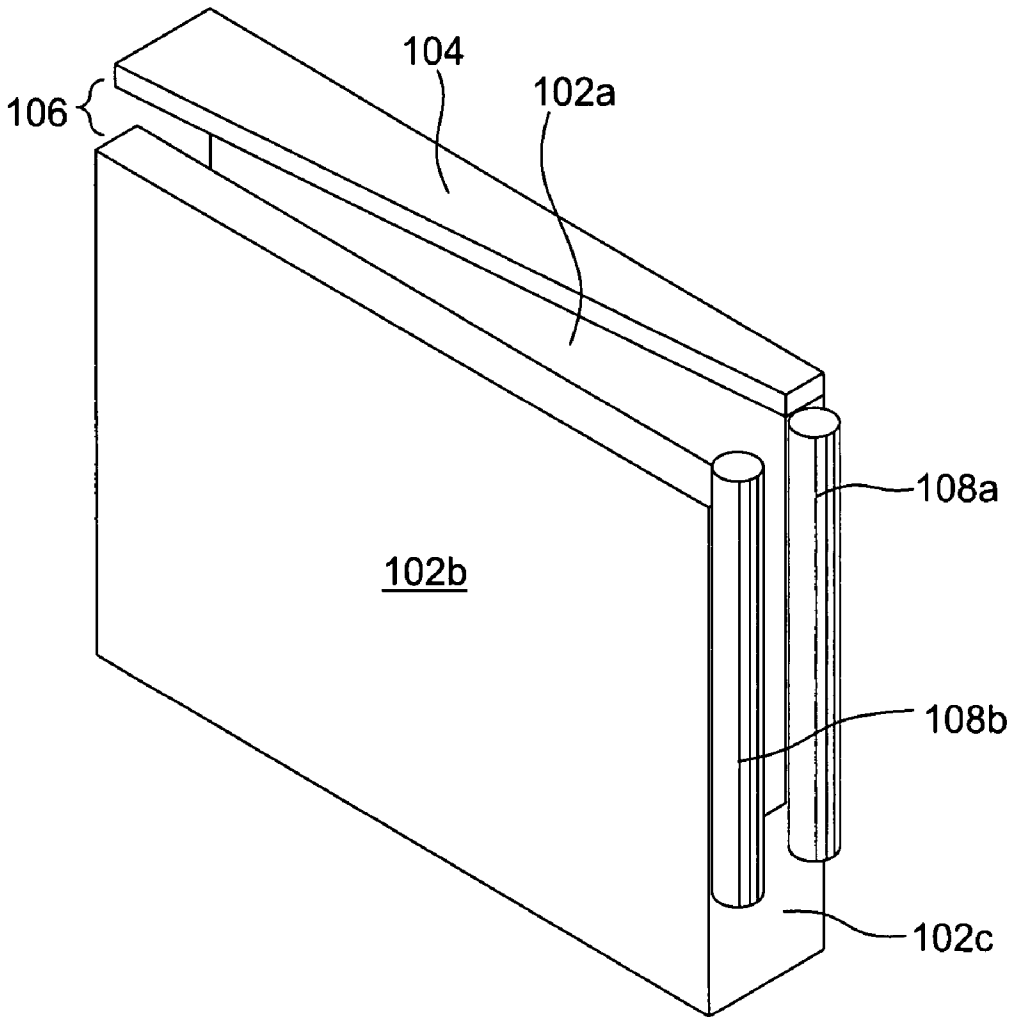
Figure 6:
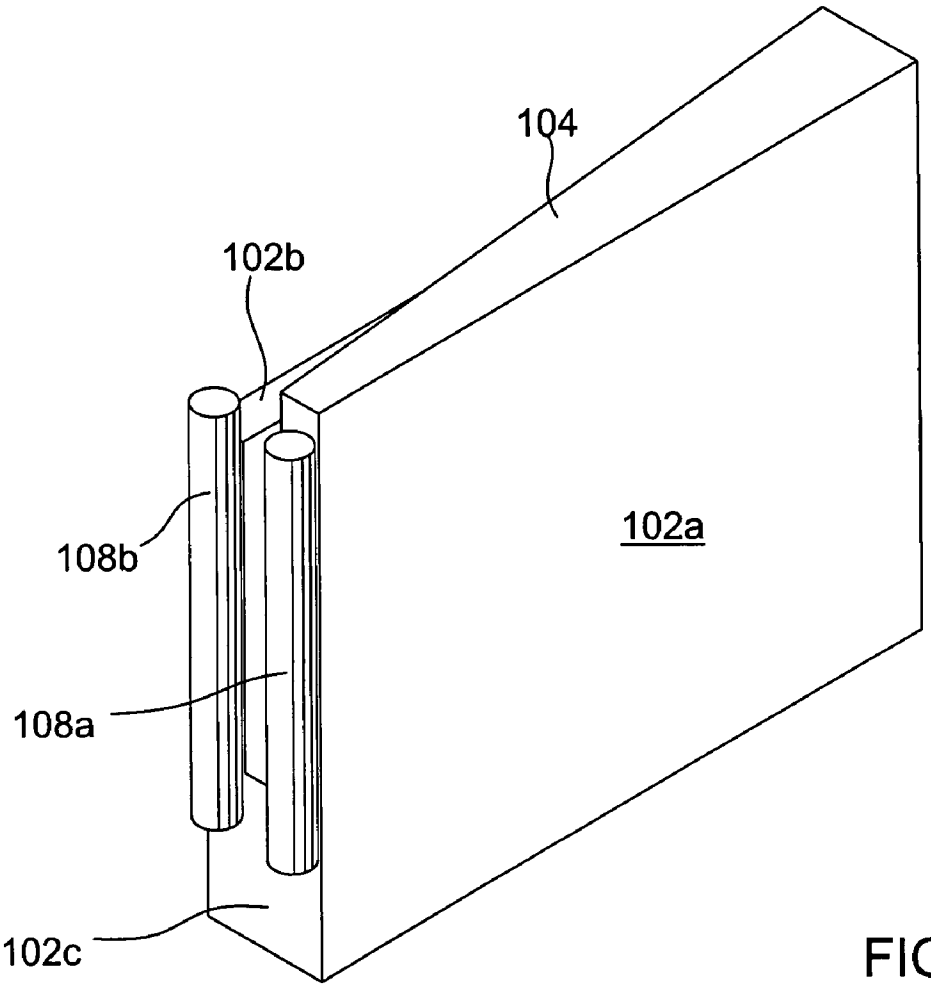
Figure 8:
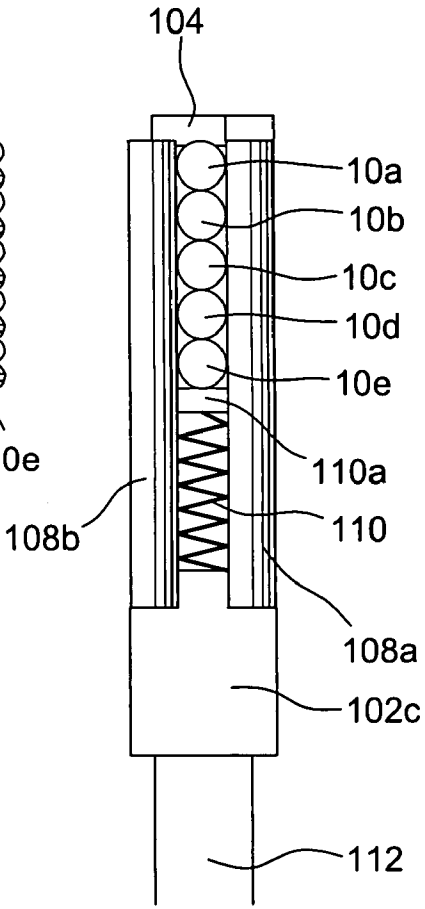
FIGS. 7-12 are schematic right side, front, left side, back, and isometric views, respectively, of an arrow holder with a stack of arrows therein.
Figure 7:
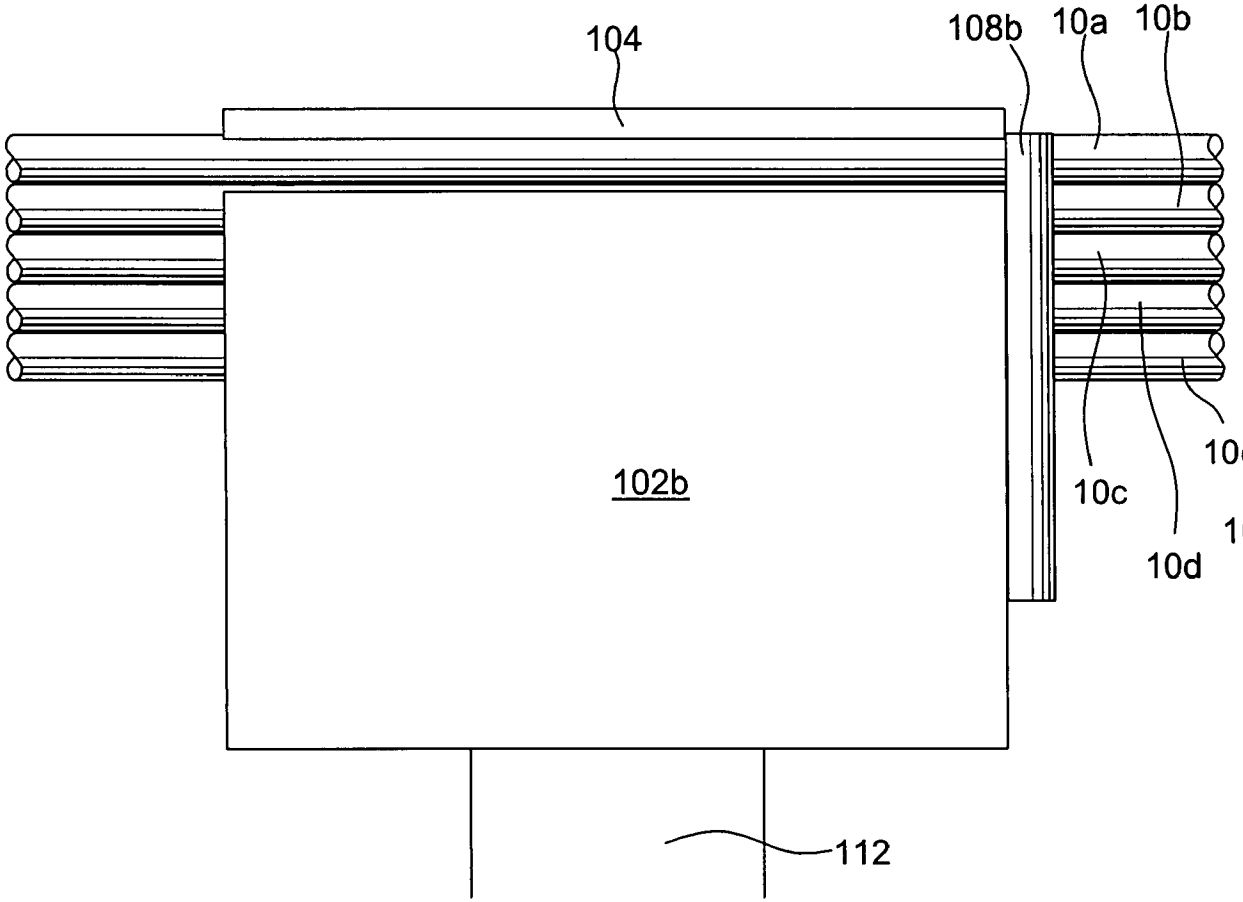
Figure 10:
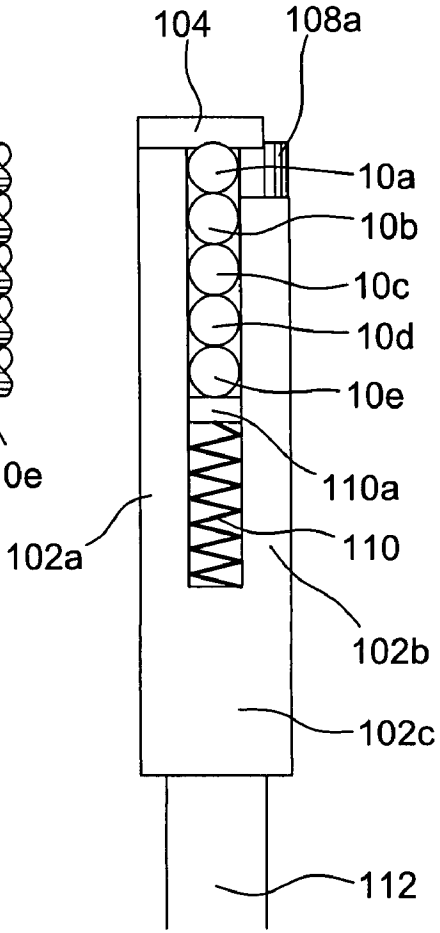
Figure 9:
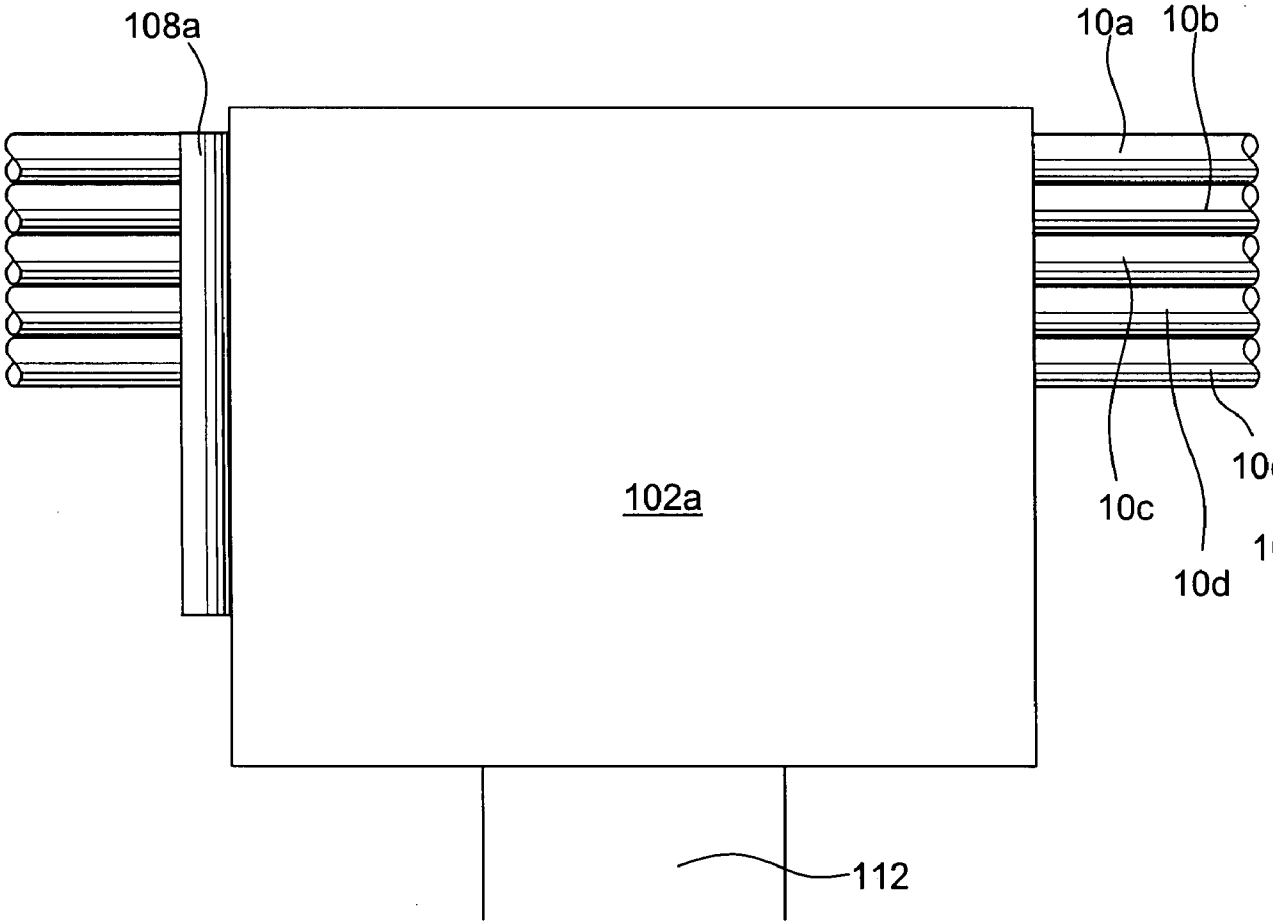
Figure 11:
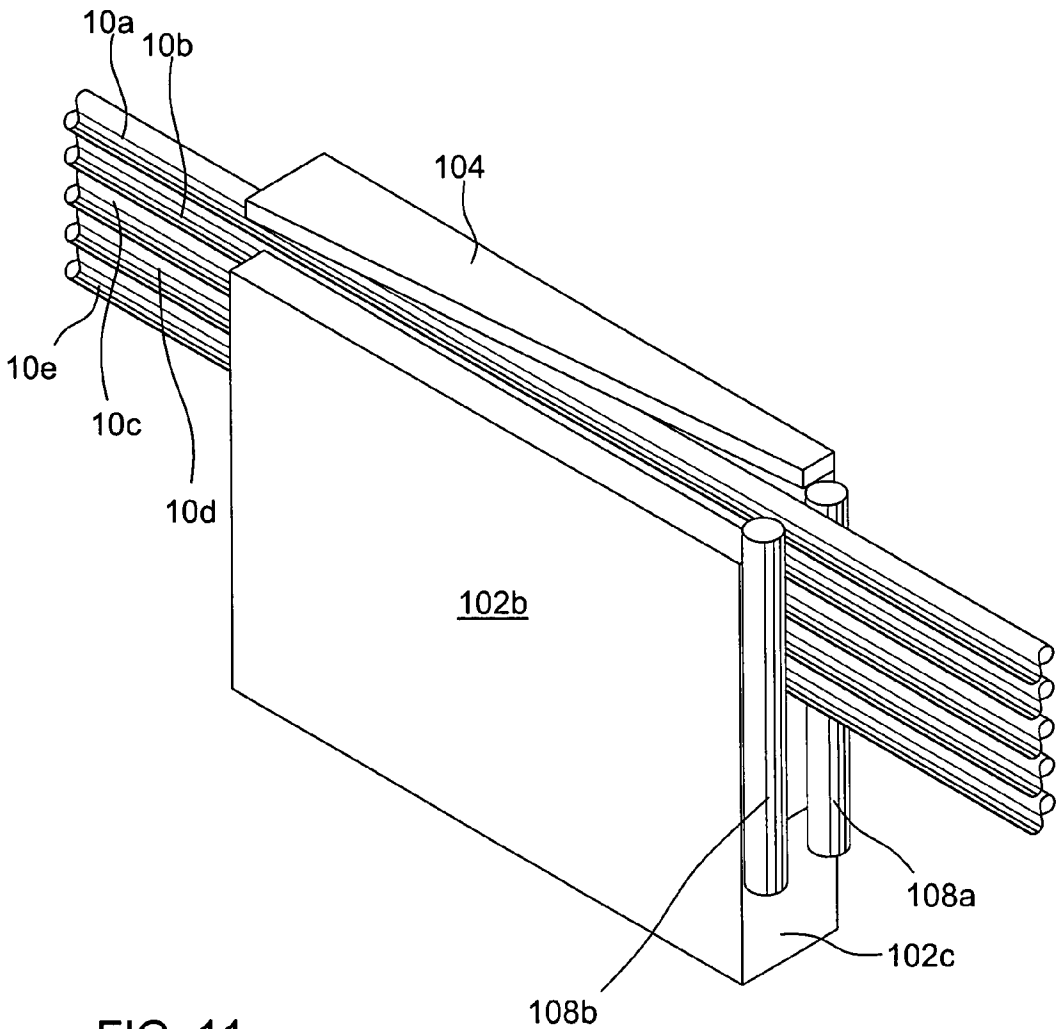
Figure 12:
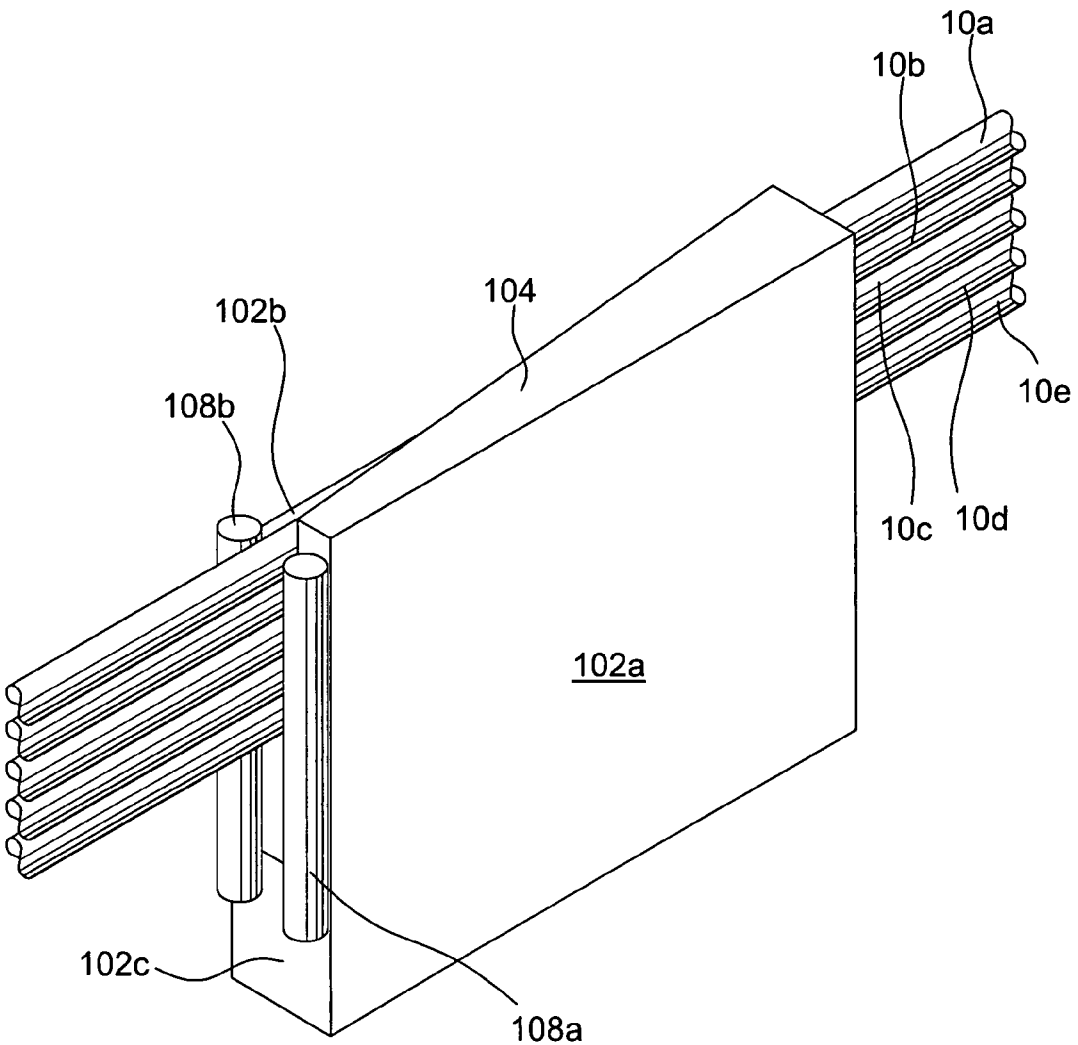

The embodiments shown in the Figures are exemplary, and should not be construed as limiting the scope of the present disclosure and/or appended claims.

DETAILED DESCRIPTION OF EMBODIMENTS

FIGS. 1-6 illustrate schematically an arrow holder 100 (equivalently, arrow clip 100). The arrow holder holds multiple arrows in a manner allowing rapid removal from the holder in preparation for nocking the arrow, drawing the bow, and shooting the arrow. In the Figures, the arrow holder is shown holding a stack of five arrows. However, it should be appreciated that an arrow holder may hold any desired number of arrows while nevertheless falling within the scope of the present disclosure or appended claims. The arrow holder 100 comprises a U-shaped bracket having substantially vertical sides 102*a* and 102*b* connected by bottom 102*c*. Sides 102*a* and 102*b* are substantially parallel and spaced apart so as to receive therebetween a single stack of arrows, with the arrows protruding beyond the front and back ends of the bracket. An arrow catch 104 extends substantially horizontally from the top edge of the first side 102*a* toward the other side 102*b*. The arrow catch 104 and bracket side 102*b* are arranged to leave a vertical gap 106 between them. The size of gap 106 is such that only one arrow at a time may pass through the gap 106 between the arrow catch 104 and the top of side 102*b*. A spring member 110 positioned within the bracket is arranged for biasing a stack of arrows within the bracket against the arrow catch 104. In the exemplary embodiments shown, the spring member 110 includes a reciprocating member 110*a*. Embodiments with or without such a reciprocating member, or employing any suitable spring or spring-like member, shall fall within the scope of the present disclosure or appended claims.

Opposed substantially vertical arrow guides 108*a* and 108*b* are positioned at the front end of the bracket, and are spaced apart so as to receive therebetween a single stack of arrows received within the bracket. Arrow guides 108*a* and 108*b* may comprise distinct members secured to the front ends of the sides 102*a* and 102*b* of the bracket (e.g. the cylindrical rods shown in the Figures), or may be integrally formed with the sides of the bracket. The arrow guides 108*a* and 108*b* extend vertically so as to constrain a top arrow of the stack. The horizontal spacing of arrow guides 108*a*/108*b* and/or sides 102*a*/102*b* (or the front or back ends thereof) may be fixed, or may be made adjustable for accommodating arrows of differing sizes. For example, the spacing may be made adjustable between about 0.015 inches and about 0.26 inches apart. Other spacings or ranges of spacings may be employed within the scope of the present disclosure or appended claims.

FIGS. 7-12 illustrate schematically the arrow holder 100 with a stack of arrows 10*a* . . . 10*e* received within. Spring member 110 biases the arrow stack against arrow catch 104. The sides 102*a*/102*b* (or the front or back ends thereof) or the arrow guides 108*a*/108*b* are suitably arranged so as to constrain horizontally arrows 10*b* . . . 10*e* (i.e. all arrows except the top arrow of the stack). The top arrow 10*a* may pass horizontally through the gap 106 between the arrow catch 104 and the top of side 102*b*. However, arrow guides 108*a* and 108*b* extend vertically beyond the top of side 102*b* so as to constrain horizontally the top arrow 10*a*.

Figures 13, 14, 15, 16:
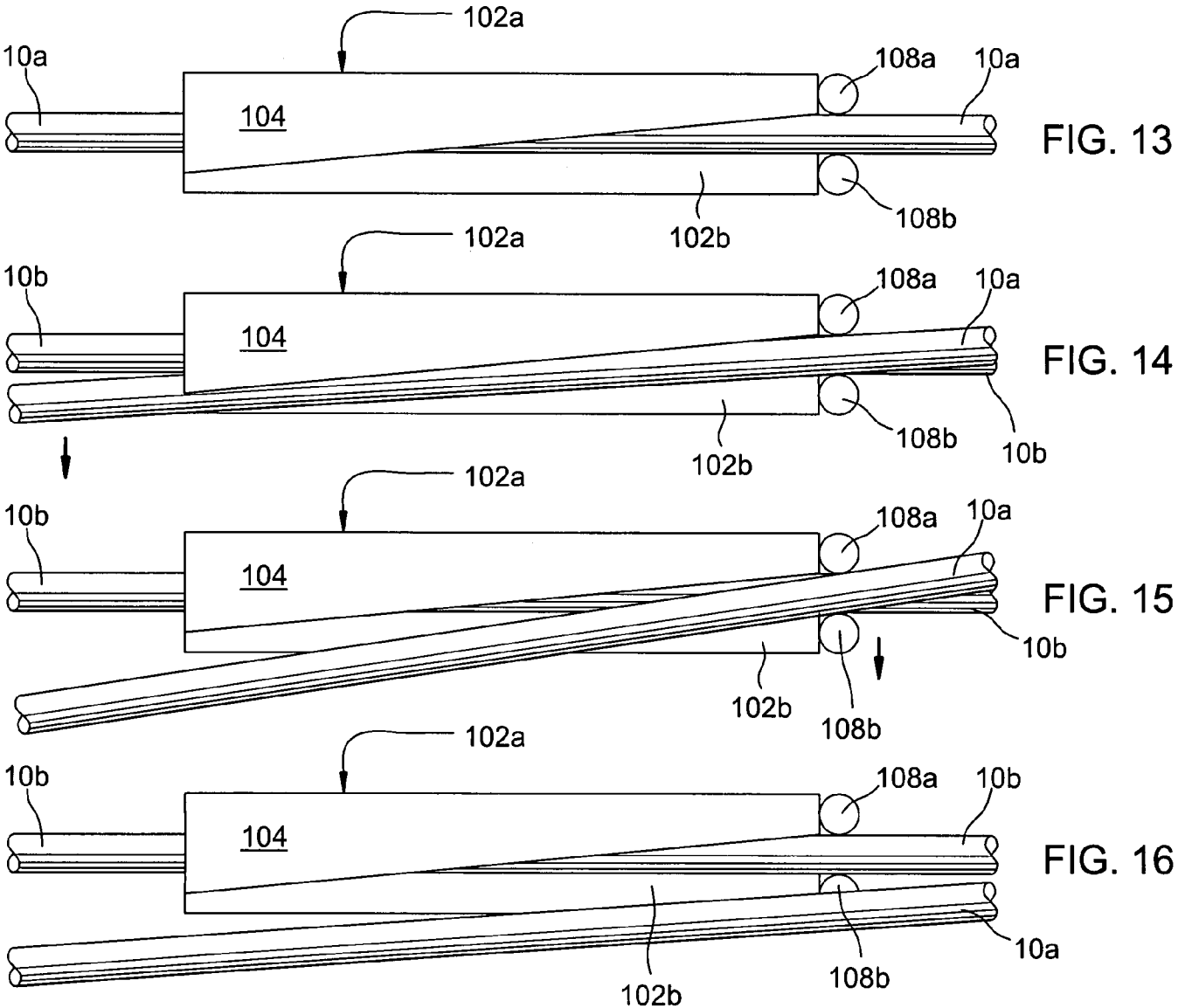
FIGS. 13-16 are schematic top views of an arrow holder with a stack of arrows therein illustrating removal of the top arrow of the stack from the arrow holder.
Figure 17:
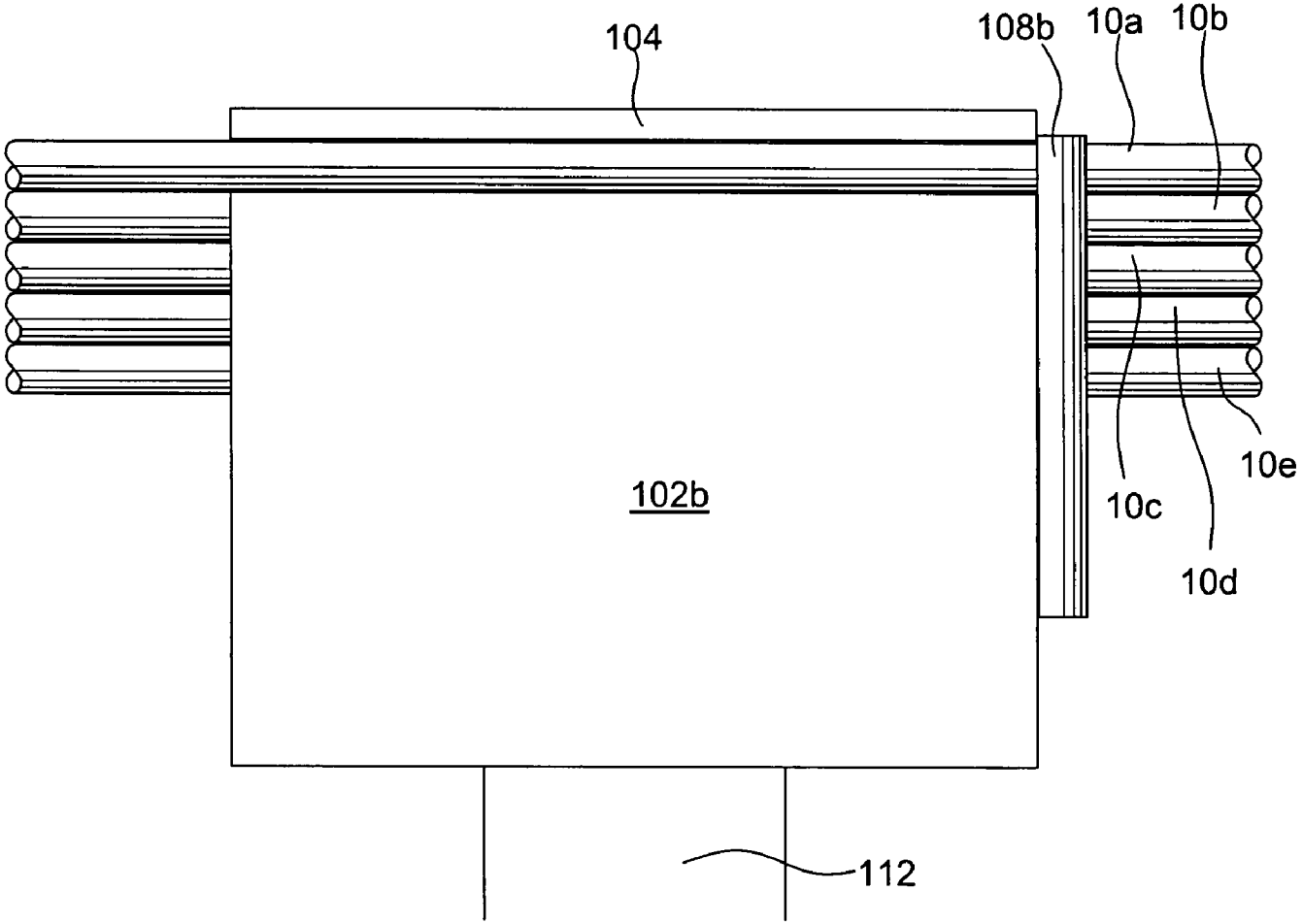
FIGS. 17 and 18 are schematic right side views of an arrow holder with a stack of arrows therein illustrating removal of the top arrow of the stack from the arrow holder.
Figure 18:
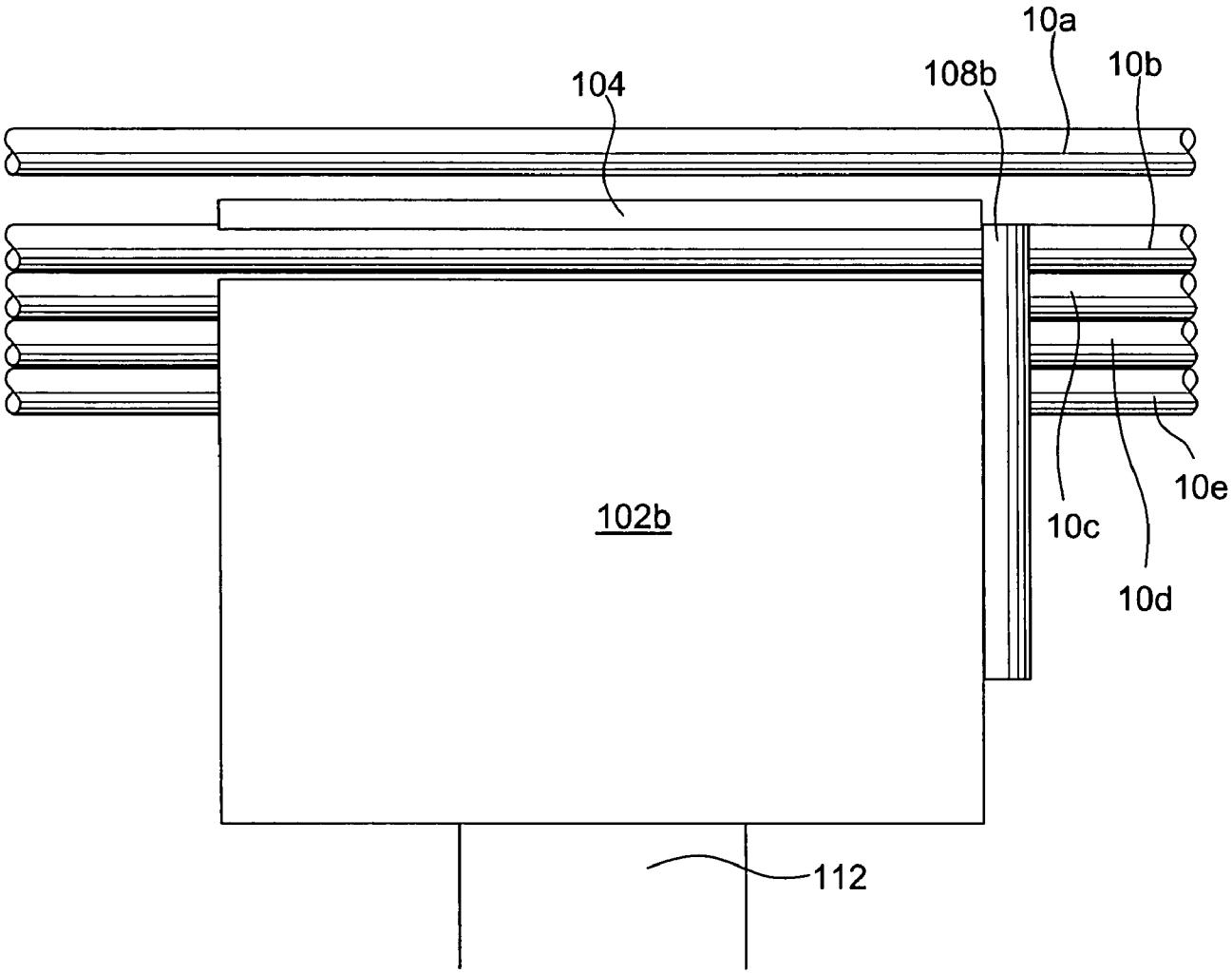

FIGS. 13-18 illustrate schematically removal of the top arrow 10*a* from the arrow holder 100. FIG. 13 is a schematic top view of the arrow holder 100 with a stack of arrows received therein before beginning to remove the top arrow 10*a*. FIG. 17 is the corresponding schematic right side view. In FIG. 14, the top arrow 10*a* begins to pivot about the arrow guides 108*a* and 108*b* and begins to pass through the gap 106, but is still biased by spring member 110 against arrow catch 104. The right side view still appears as in FIG. 17 at this stage. In FIG. 15, the top arrow 10*a* has pivoted sufficiently to clear the arrow catch 104, and the spring member 104 biases the remainder of the arrow stack (arrows 10*b* . . . 10*e*) against arrow catch 104. This results in the top arrow 10*a* being moved upward above the arrow guides 108*a*/108*b*, thereby releasing it from the arrow holder 100 and allowing its removal (FIGS. 16 and 18). With sufficient force exerted by spring member 110, the released arrow 10*a* may be cast upward and away from the arrow holder. This procedure may be repeated for each successive arrow in the stack, until all arrows have been removed. The arrow holder may be reloaded at any time by inserting one or more arrows (or additional arrows) into the arrow holder so that they form an arrow stack received within the bracket and biased against the arrow catch 104 by the spring member 110.

The U-shaped bracket may be formed in any suitable configuration or arrangement; that shown in the Figures is exemplary only, and is not intended to limit the scope of the disclosure or appended claims. The arrow catch 104 may be formed in any configuration or arrangement suitable for retaining the arrow stack within the bracket biased by spring member 110, and for enabling pivoting and release of the top arrow as described herein. One such arrangement or configuration may include a longitudinal groove 104*a* on the arrow catch for engaging the top arrow 10*a*. Such a groove may serve to maintain the top arrow 10*a* aligned with the bracket prior to pivot and release, but to nevertheless enable said pivot and release. Another such arrangement or configuration may include an arrow catch 104 that decreases in horizontal extent toward the front end of the bracket. For example, in the exemplary embodiment shown in the Figures the arrow catch 104 is shown as a substantially horizontal triangular plate extending from side 102*a* toward side 102*b* of the bracket and decreasing in width toward the front end of the bracket. The arrow guides 108*a*/108*b* may be formed in any arrangement suitable for constraining horizontally the arrow stack and for enabling pivoting of the top arrow 10*a*. In the exemplary embodiment shown in the Figures the arrow guides comprise a pair of substantially cylindrical rods secured to the front end of the bracket.

Figure 20:
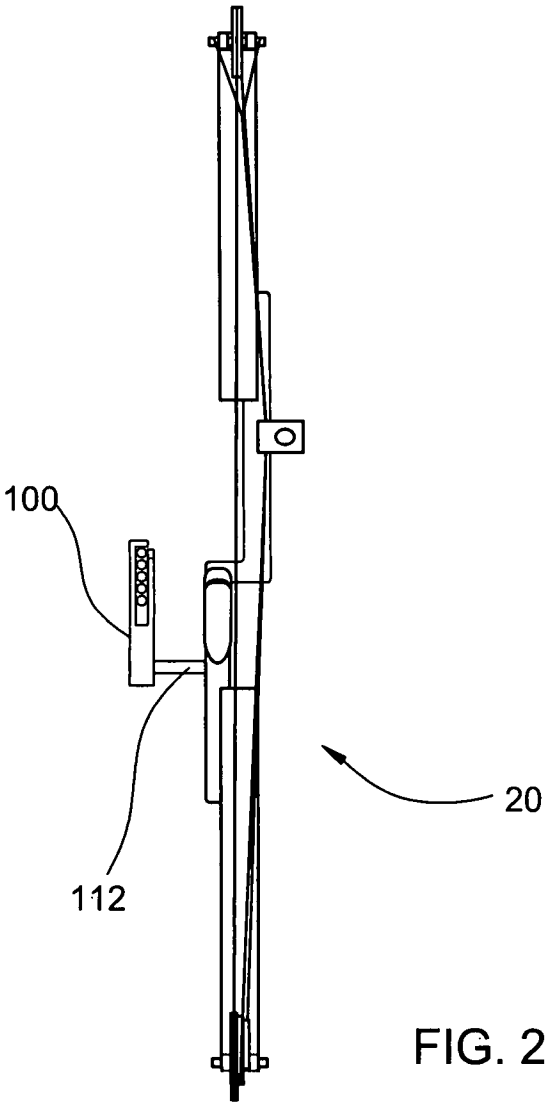
FIGS. 19 and 20 schematically illustrate an arrow holder mounted on an archery bow.
Figure 19:
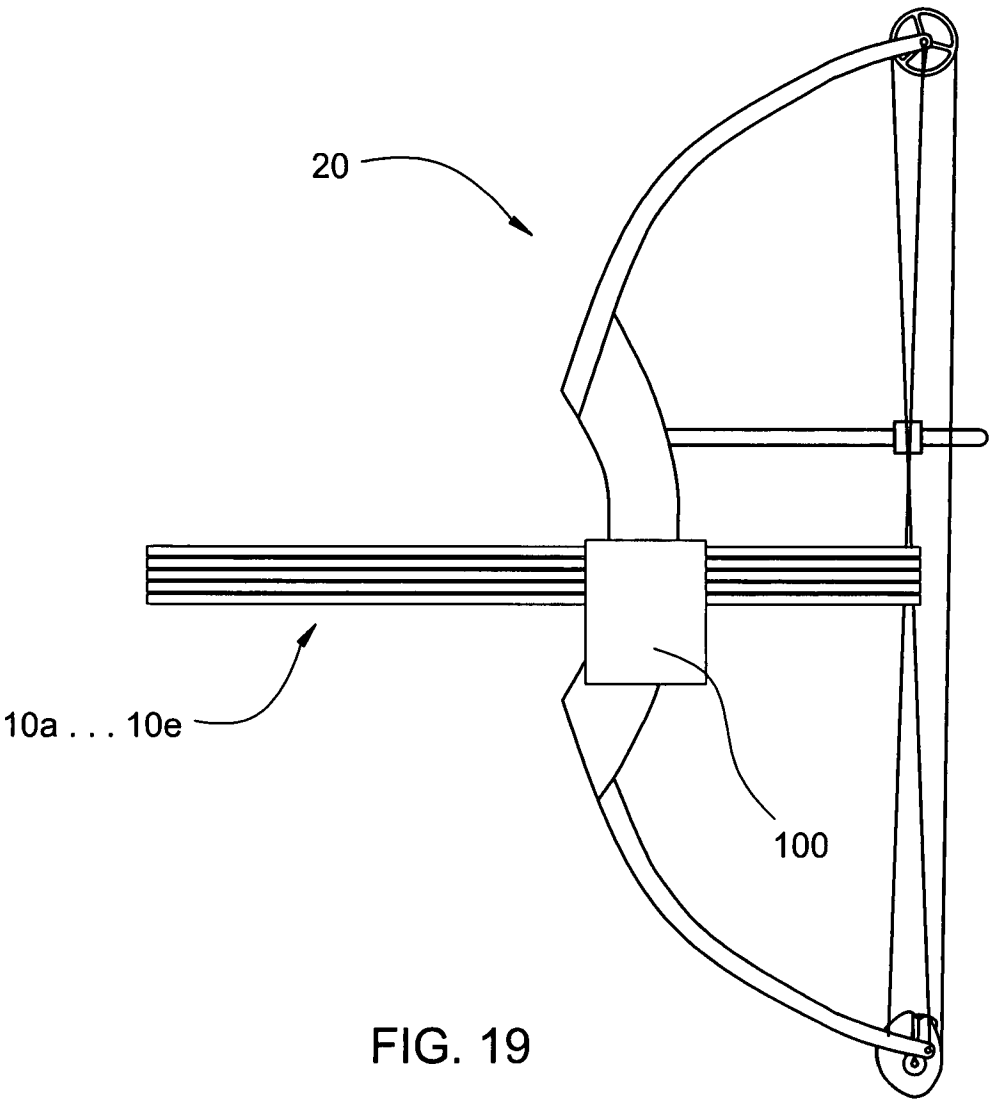

A mounting bracket 112 is shown in some of the Figures, and serves to mount the arrow holder 100 on an archery bow 20 (FIGS. 19-20). The arrow holder 100 is mounted in a location relative to bow 20 so that arrows held therein may be readily reached by an archer using the bow. The arrow holder 100 may be mounted so that the gap 106 faces the bow, and so that the back end of the bracket is toward the back of the bow, and may be further arranged with the gap facing the rest side of the bow (i.e., the side of the bow where the arrow rests prior to shooting). In this arrangement, the held arrows are already in the proper orientation for nocking, drawing, and shooting, and the movements required to release the top arrow 10*a* from the arrow holder also serve to move the released arrow toward the arrow rest to prepare for nocking, drawing, and shooting. If the spring member 110 casts the released arrow upward, this may further assist the movement of the released arrow toward the arrow rest. The mounted arrow holder 100 may be positioned relative to the bow 20 so that the nock ends of the arrow 10*a* . . . 10*e* are close enough to the bowstring 22 so that the archer can reach the nock of arrow 10*a* while his/her thumb and forefinger remain around the bowstring. Such a configuration enables the archer to rapidly release an arrow from the arrow holder and nock the arrow in preparation for drawing the bow and shooting the arrow. When mounted on archery bow 20 and holding multiple arrows, arrow holder 100 may enable a skilled archer to rapidly and repetitively shoot and reload in succession multiple arrows held in the holder. Such capability may be valuable when participating in speed-shooting contests, or when hunting fast-moving or numerous game, or in other circumstances calling for rapid shooting of multiple arrows.

The exemplary embodiment shown in the Figures is oriented with the arrows stacked vertically in a substantially horizontal orientation, and the terms "vertical" and "horizontal" have been used for describing relative positions and movements. However, these terms are intended to indicate relative directions or orientations. In some embodiments falling within the scope of the present disclosure or appended claims, it may be desirable to mount the arrow holder as shown in the Figures, with substantially horizontal arrows in a substantially vertical stack. In other embodiments falling within the scope of the present disclosure or appended claims, however, it may be desirable to mount arrow holder with substantially vertical arrows in a substantially horizontal stack, or in some other orientation. Such differing orientations may be useful for accommodating larger numbers of arrows loaded into the arrow holder, for accommodating variations in geometry among archery bows, for accommodating variations in size or proportions among archers, or for other reasons. A given embodiment may be designed for mounting in only one orientation, or may be made for mounting in a variety of user-selected or adjustable orientations.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

What is claimed is:

1. An arrow holder, comprising:

a U-shaped bracket having a bottom and first and second opposed substantially vertical sides, the sides being substantially parallel and spaced apart so as to receive therebetween a single stack of arrows within the bracket with the arrows protruding beyond front and back ends of the bracket;

an arrow catch extending substantially horizontally from a top edge of the first side of the bracket toward the second side and positioned so as to leave a vertical gap between the arrow catch and a top edge of the second side of the bracket for enabling one arrow at a time to pass between the arrow catch and the top edge of the second side;

a spring member positioned within the bracket for biasing an arrow stack within the U-shaped bracket against the arrow catch; and first and second opposed substantially vertical arrow guides at the front end of the bracket, the arrow guides being spaced apart so as to receive the single stack of arrows therebetween, the first and second arrow guides extending vertically so as to constrain horizontally a top arrow of the arrow stack, wherein the bracket, arrow catch, arrow guides, and spring member are arranged for:

enabling a top arrow of the received arrow stack to pivot substantially horizontally about the arrow guides and pass through the vertical gap between the arrow catch and the top edge of the second side of the bracket;

releasing the top arrow of the received arrow stack from the arrow holder when the top arrow pivots about the arrow guides through an angle sufficient to clear the arrow catch; and biasing a remainder of the received arrow stack against the arrow catch if the top arrow is released.

2. The apparatus of claim 1, further comprising a mounting bracket arranged for mounting the arrow holder on an archery bow with the vertical gap facing the bow and with the back end of the bracket toward the rear of the bow.

3. The apparatus of claim 2, wherein the mounting bracket and arrow holder are arranged for enabling an archer, when the arrow holder is mounted on the archery bow, to reach the nock of the top arrow of the received arrow stack while the archer's thumb and forefinger remain around a bowstring of the archery bow.

4. The apparatus of claim 2, wherein the mounting bracket and arrow holder are arranged for mounting the arrow holder on the archery bow with the vertical gap facing the arrow rest side of the bow.

5. The apparatus of claim 2, further comprising an archery bow, wherein the arrow holder is mounted on the archery bow.

6. The apparatus of claim 1, wherein the horizontal extent of the arrow catch decreases toward the front end of the bracket.

7. The apparatus of claim 6, wherein the arrow catch comprises a substantially horizontal triangular plate.

8. The apparatus of claim 1, wherein the arrow catch includes a longitudinal groove for engaging the top arrow of the arrow stack biased against the arrow catch.

9. The apparatus of claim 1, wherein the back end of the bracket or the arrow guides are arranged for constraining horizontally the arrow stack.

10. The apparatus of claim 1, wherein each arrow guide comprises a substantially cylindrical rod secured to the front end of the bracket.

11. The apparatus of claim 1, wherein the arrow guides are arranged so that the released top arrow of the arrow stack is substantially unconstrained horizontally.

12. A method, comprising pivoting substantially horizontally about opposed first and second substantially vertical arrow guides positioned at a front end of a U-shaped bracket of an arrow holder a top arrow of a single stack of arrows received within the bracket so that the top arrow passes through a vertical gap between a top edge of a second substantially vertical side of the bracket and an arrow catch extending horizontally from a top edge of a first substantially vertical side of the bracket toward the second side of the bracket and clears the arrow catch thereby releasing the top arrow of the arrow stack from the arrow holder, the U-shaped bracket comprising a bottom and the two substantially vertical sides, the two substantially vertical sides being substantially parallel and spaced apart so as to receive therebetween the single stack of arrows within the bracket with the arrows protruding beyond front and back ends of the bracket and with the arrow stack biased within the bracket against the arrow catch by a spring member positioned within the bracket, the vertical gap enabling one arrow at a time to pass between the arrow catch and the top edge of the second side of the bracket, the first and second arrow guides being spaced apart to receive therebetween the single stack of arrows and extending vertically so as to constrain horizontally the top arrow of the arrow stack, the spring member biasing a remainder of the arrow stack against the arrow catch after release of the top arrow of the arrow stack from the arrow holder.

13. The method of claim 12, further comprising inserting the single stack of arrows into the U-shaped bracket with the arrows protruding from both ends of the bracket with the arrow stack biased by the spring member against the arrow catch.

14. The method of claim 12, wherein the arrow holder is mounted on an archery bow with a mounting bracket with the vertical gap facing the bow and with the back end of the bracket toward the rear of the bow.

15. The method of claim 14, wherein the mounting bracket and arrow holder are arranged for enabling an archer, when the arrow holder is mounted on the archery bow, to reach the nock of the top arrow of the received arrow stack while the archer's thumb and forefinger remain around a bowstring of the archery bow.

16. The method of claim 14, wherein arrow holder is mounted on the archery bow with the vertical gap facing the arrow rest side of the bow.

17. The method of claim 12, wherein the horizontal extent of the arrow catch decreases toward the front end of the bracket.

18. The method of claim 17, wherein the arrow catch comprises a substantially horizontal triangular plate.

19. The method of claim 12, wherein the arrow catch includes a longitudinal groove for engaging the top arrow of the arrow stack biased against the arrow catch.

20. The method of claim 12, wherein the back end of the bracket or the arrow guides are arranged for constraining horizontally the arrow stack.

21. The method of claim 12, wherein each arrow guide comprises a substantially cylindrical rod secured to the front end of the bracket.

22. The method of claim 12, wherein the arrow guides are arranged so that the released top arrow of the arrow stack is substantially unconstrained horizontally.

* * * * *